US007477574B2

(12) United States Patent
Takiguchi

(10) Patent No.: US 7,477,574 B2
(45) Date of Patent: Jan. 13, 2009

(54) DECORATIVE BODY DRIVING MECHANISM

(75) Inventor: Fumiaki Takiguchi, Tokyo (JP)

(73) Assignee: Seiko Clock Inc., Tokyo (JP)

( * ) Notice: Subject to any disclaimer, the term of this patent is extended or adjusted under 35 U.S.C. 154(b) by 331 days.

(21) Appl. No.: 11/134,726

(22) Filed: May 20, 2005

(65) Prior Publication Data

US 2005/0259522 A1 Nov. 24, 2005

(30) Foreign Application Priority Data

May 24, 2004 (JP) ..... 2004-152643

(51) Int. Cl.
*G04B 21/02* (2006.01)
*G04B 19/00* (2006.01)
*G04B 25/00* (2006.01)

(52) U.S. Cl. ..... 368/75; 368/272

(58) Field of Classification Search ..... 368/276, 368/327, 75, 272–275
See application file for complete search history.

(56) References Cited

U.S. PATENT DOCUMENTS 4,941,137 A * 7/1990 Kikuchi ..... 368/223
4,993,006 A * 2/1991 Oshima et al. ..... 368/231
5,161,130 A * 11/1992 Sato et al. ..... 368/228
5,438,154 A * 8/1995 Segan et al. ..... 84/600
7,104,589 B2 * 9/2006 Takeda et al. ..... 296/146.8
7,126,885 B2 * 10/2006 Marinero et al. ..... 369/13.14
7,140,589 B2 * 11/2006 Woodard et al. ..... 248/421

FOREIGN PATENT DOCUMENTS

JP 8068869 3/1996
JP 200317185 A * 6/2003

* cited by examiner

*Primary Examiner*—Vit W Miska
(74) *Attorney, Agent, or Firm*—Michaud-Duffy Group LLP

(57) ABSTRACT

A decorative body driving mechanism having a decorative body therein and at least one openable and closable door arranged in front of the decorative body, the mechanism includes a door open and close mechanism and a decorative body operating mechanism. The door open and close mechanism includes a first gear rotatable in both directions with a motor, and a second gear being engaged with the first gear only within a given range to rotate intermittently and open and close the door. The decorative body operating mechanism transmits a driving force of the motor to the decorative body to make the decorative body move. It is possible to open and close the door and operate the decorative body with the single motor, and the door can be opened and closed intermittently by the door open and close mechanism. The decorative body can be worked without transmitting the driving force to the door.

3 Claims, 7 Drawing Sheets

DECORATIVE BODY DRIVING MECHANISM

BACKGROUND OF THE INVENTION

1.Field of the Invention

This invention generally relates to decorative body driving mechanisms, the decorative body driving mechanism having a decorative body in a main body thereof and at least one openable and closable door arranged in front of the decorative body so that the door can be opened at a given time to make the decorative body come out, and more particularly, to a decorative body driving mechanism which is capable of opening and closing at least one openable and closable door and operating the decorative body with a single motor.

2.Description of the Related Art

Conventionally, a timepiece having a decorative body therein has been well known. The timepiece opens the door to make the decorative body come out at given times such as the hour and make the decorative body move for a certain period of time, for example, with music, and then closes the door to house the decorative body. The aforementioned timepiece having the decorative body needs a source of power to open and close the door and operate the decorative body. In other words, the above-mentioned timepiece requires the motors equal in number to objects to be operated, whereas the normal timepiece displays the time only. It is to be noted that the production cost increase as the number of motors increases. In addition, a space has to be made for the motors, and accordingly the timepiece becomes larger.

Japanese Patent Application Publication No. 8-68869 (hereinafter referred to as Document 1) proposes a mechanism for opening and closing a door of a timepiece having a decorative body therein, the mechanism being capable of opening and closing the door and operating the decorative body with a single motor. This mechanism includes a first gear and a second gear disposed coaxially, and the second gear is bonded to slip. The motor is configured to rotate the first gear by way of a decelerating gear train, and the coaxially disposed second gear rotates to open and close the door. Additionally, a stopper is provided at a fully opened position of the door. Further, the mechanism is configured to include a drive transmission gear engaged with any one of the decelerating gear train or the first gear. The drive transmission gear thus operates the decorative body.

The mechanism of Document 1 includes the two gears that are coaxially disposed and bonded to slip. When the door stops at the fully opened position, slipping between the two gears can maintain the rotation of the motor. Therefore, even after the door stops at the fully opened position, the rotational force of the motor can be transmitted to the drive transmission gear to maintain the movement of the decorative body.

The mechanism of Document 1,however, continuously generates the force to open the door even after the door fully opens. This is why the two gears are slipped to release the aforementioned force. However, if the two gears are slipped in this manner, the contact part will be worn and will easily be slipped more than ever. This makes it difficult to rotate the two gears simultaneously with the use of friction, resulting in a problem in that the door cannot be opened or closed accurately. Moreover, there arises another problem in that the slipped gears make a friction sound and this disturbing noise damages the musical performance while the decorative body is moving with music. Besides, the motor is always connected with the gear that opens and closes the door in the mechanism of Document 1.Therefore, when the rotation of the motor is changed to close the door, the door starts to close immediately. The rotational direction of the motor is thus limited, and this arises yet another problem in that the performance made by the decorative body is limited to a monotonous action such as a rotation in one direction or the like.

SUMMARY OF THE INVENTION

It is a general object of the present invention to solve the above problems and provide a decorative body driving mechanism, which is capable of opening and closing at least one door and operating the decorative body with a single motor and is also capable of operating the decorative body without transmitting the driving force to the door.

According to one aspect of the present invention, preferably, there is provided a decorative body driving mechanism having a decorative body therein and at least one openable and closable door arranged in front of the decorative body, the mechanism including a door open and close mechanism and a decorative body operating mechanism, the door open and close mechanism including a first gear rotatable in both directions with a motor, and a second gear being engaged with the first gear only within a given range to rotate intermittently and open and close said at least one openable and closable door, the decorative body operating mechanism transmitting a driving force of the motor to the decorative body to make the decorative body move.

It is thus possible to open and close said at least one door and operate the decorative body with a single motor, and it is also possible to open and close the door intermittently with the door open and close mechanism. The decorative body can be worked without transmitting the driving force to the door.

BRIEF DESCRIPTION OF THE DRAWINGS

Preferred embodiments of the present invention will be described in detail with reference to the following drawings, wherein.

DESCRIPTION OF THE PREFERRED EMBODIMENTS

Figure 1C:
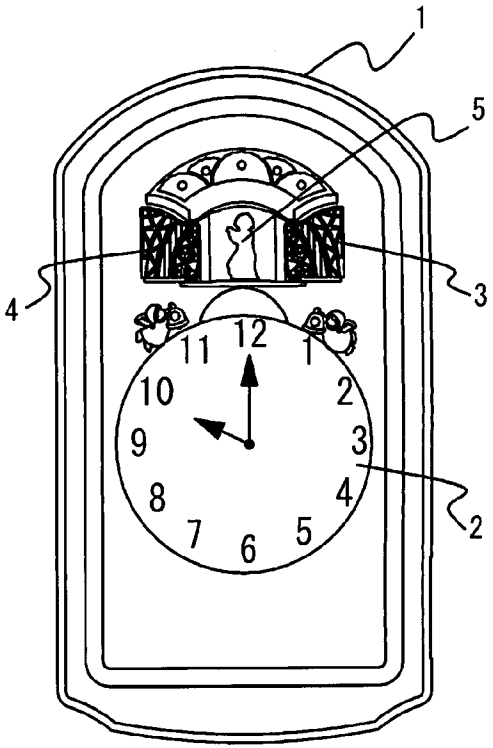
FIGS. 1A through 1C show changes in appearance of a timepiece having a decorative body in accordance with an embodiment of the present invention.
Figure 1B:
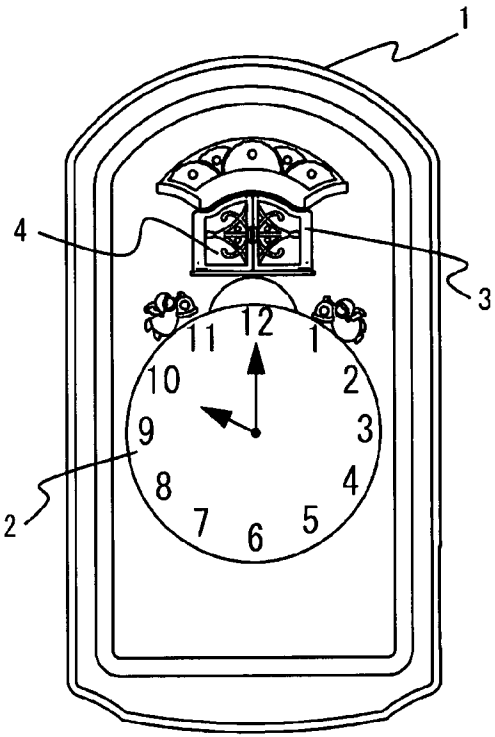
Figure 1A:
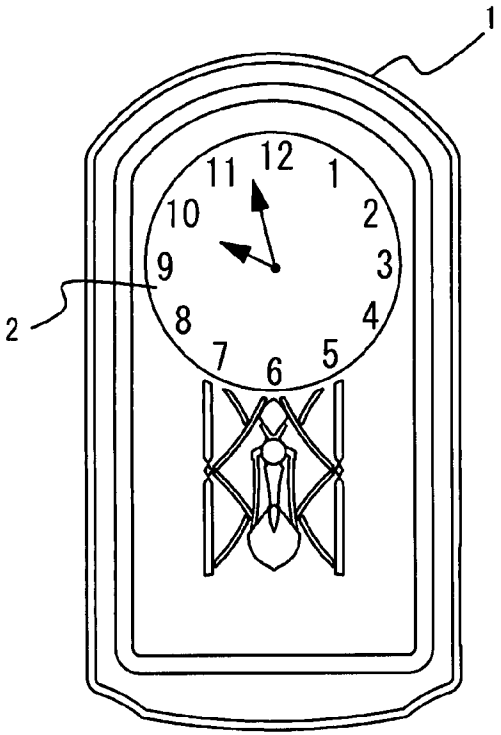

A description will be given, with reference to the accompanying drawings, of a timepiece 1 having a decorative body. The timepiece 1 serves as a decorative body driving mechanism in accordance with an embodiment of the present invention. FIGS. 1A through 1C show changes in appearance of the timepiece 1 having the decorative body. FIG. 1A shows the timepiece 1 that normally displays the time. FIGS. 1B and 1C show how the timepiece 1 changes the appearance thereof on the hour (for example, at 10 o'clock). Referring to FIG. 1B, a clock face 2 moves downward when the hour comes and a moving work that has been hidden behind the clock face 2 appears. Referring to FIG. 1C, openable and closable doors 3 and 4, which are respectively provided in the left and right, are opened to make a doll 5 come out, which is the decorative body, and the doll 5 makes a given movement (performance). In accordance with the present embodiment, the decorative body is driven on the hour, however, the driving timing is not limited to the hour, and may be changed as necessary.

Figure 2:
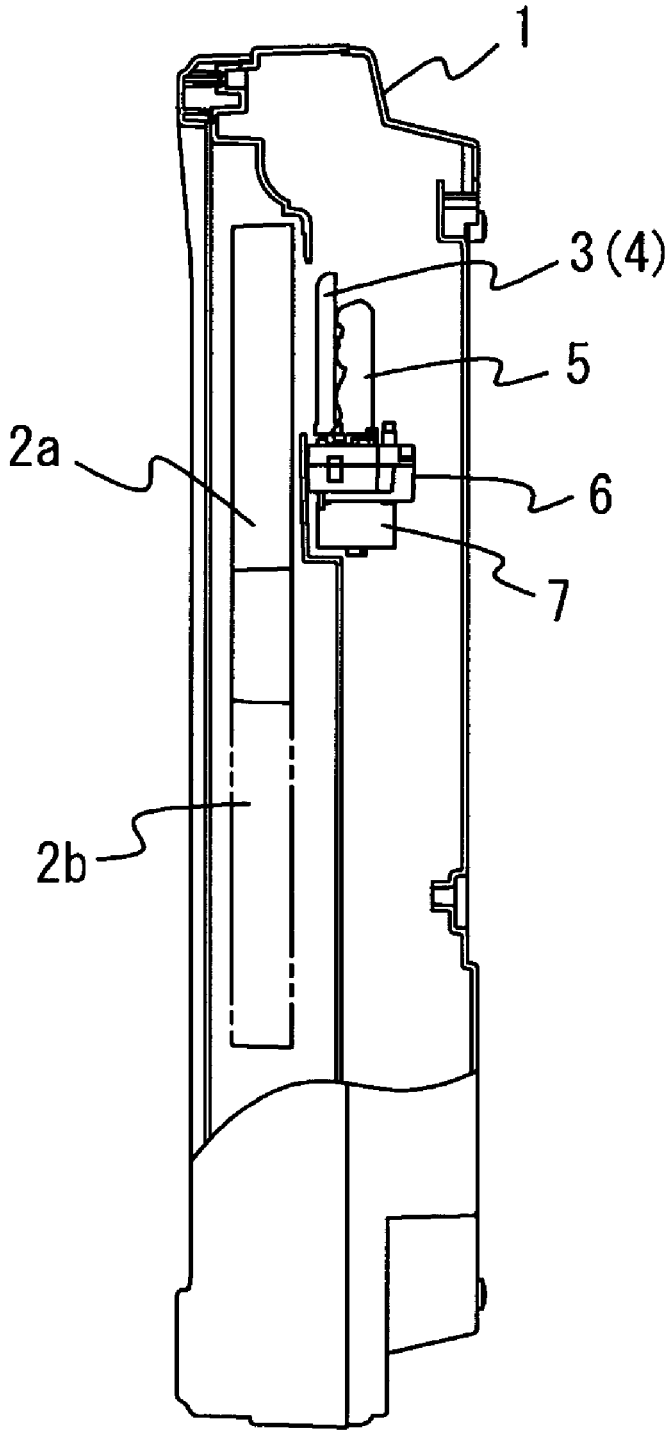
FIG. 2 is a side view of the timepiece so as to show an internal configuration thereof.

FIG. 2 is a side view (cross-sectional view of substantial members) of the timepiece 1 having the decorative body so as to show an internal configuration thereof. FIG. 2 includes a normal position 2*a* of the clock face 2 and a lower position 2*b* to expose the moving work. As shown in FIG. 2, the timepiece 1 includes the doll 5 behind the clock face 2. A pair of left and right doors 3 and 4, which open outward, are arranged between the clock face 2 and the doll 5. When a given time such as the hour comes, a driving mechanism, not shown, moves the clock face 2 to the lower position 2*b*.After the clock face 2 reaches the lower position 2*b*,the doors 3 and 4 open and the doll gives a performance. The timepiece 1 includes a mechanism body 6 and a single drive motor 7 under the doll 5 in order to open and close the doors 3 and 4 and operate the doll 5. A description will be given of a configuration of the single motor 7 and the mechanism body 6 in order to open and close the doors 3 and 4 and move the doll 5.

Figure 3A:
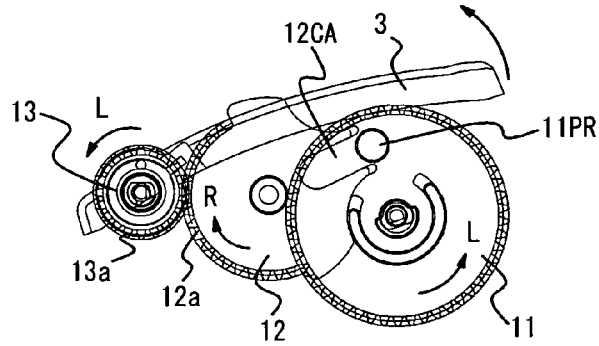
FIGS. 3A through 3D are views illustrating Geneva mechanism that opens and closes a door.

The mechanism body 6 uses Geneva mechanism so as to open and close the doors 3 and 4. A description will be given of the Geneva mechanism. FIGS. 3A through 3D are views illustrating the Geneva mechanism that opens and closes the door 3. The motor 7 makes a first gear 11 rotate in both directions. FIG. 3A shows when the door 3 is closed. From this state, the first gear 11 rotates counterclockwise only in a direction L. A transmitting gear (a second gear) 12 having a slot 12CA is provided adjacently to the first gear 11. The first gear 11 has an engagement pin (Geneva pin) 11PR on a top surface thereof. When the first gear 11 rotates counterclockwise in the direction L, the engagement pin 11PR is engaged with the slot 12CA. The first gear 11 further rotates, and the engagement pin 11PR rotates the position of the slot 12CA clockwise in a direction R. The transmitting gear 12 thus rotates in the direction R. The first gear 11 and the transmitting gear 12 form the so-called Geneva mechanism.

Figure 3B:
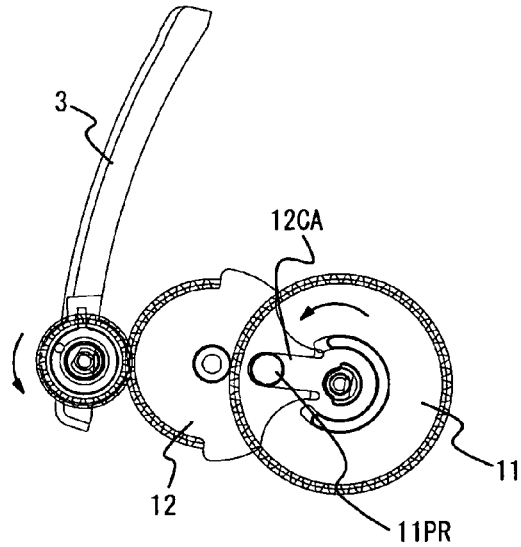
Figure 3C:
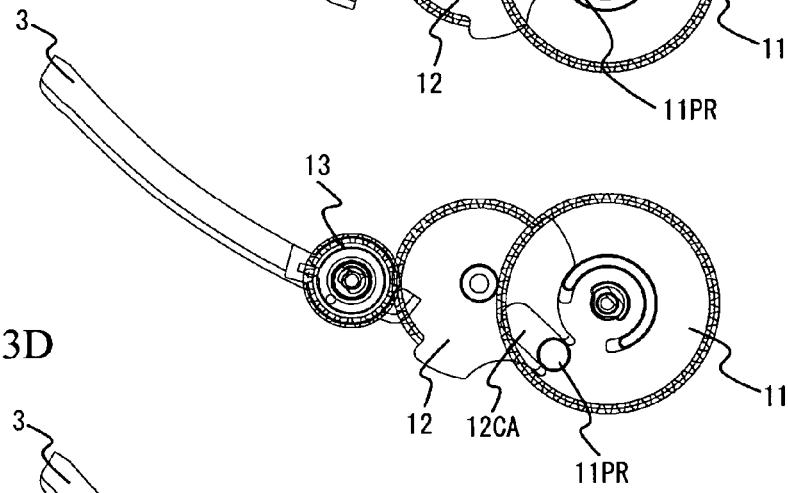

The slot 12CA of the transmitting gear 12 is configured to engage the engagement pin 11PR, only when the first gear 11 rotates and the engagement pin 11PR comes to a given position. Therefore, the transmitting gear 12 rotates only within a given range (as shown in FIGS. 3A through 3C), being engaged with the first gear 11. That is to say, the first gear 11 intermittently rotates the transmitting gear 12.

Figure 3D:
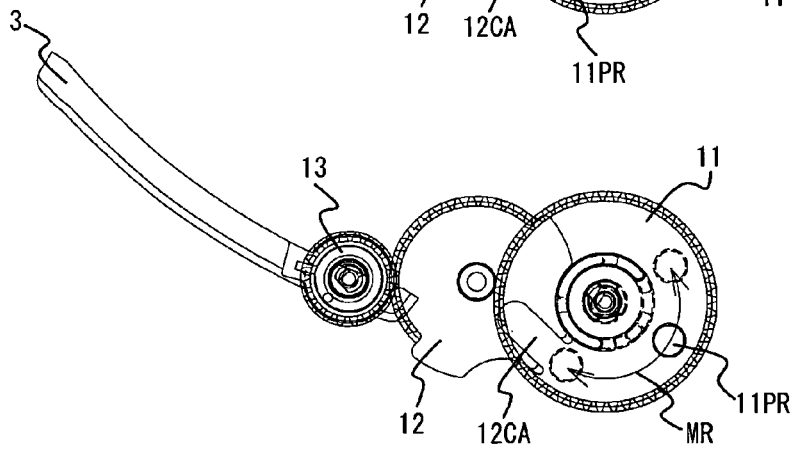

A row of teeth 12*a* is arranged on a circumference of the transmitting gear 12. The row of teeth 12*a* is configured to engage with a row of teeth 13*a* of a gear 13, which is fixed to the door 3. If the transmitting gear 12 rotates clockwise in the direction R, the door 3 rotates counterclockwise in the direction L through the gear 13 (to the left (to open the door) as shown in FIGS. 3A through 3C). FIGS. 3A through 3C continuously show how the door 3 is opened. If the first gear 11 further keeps on rotating counterclockwise in the direction L, the engagement pin 11PR removes from the slot 12CA as shown in FIG. 3D. The rotational force is not transmitted to the transmitting gear 12 any longer, even if the first gear 11 subsequently rotates counterclockwise in the direction L.

As shown in FIGS. 3A through 3D, the Geneva mechanism allows the transmitting gear 12 to rotate only within a range where the engagement pin 11PR is engaged with the slot 12CA. After the engagement pin 11PR is removed from the slot 12CA, the transmitting gear 12 is not affected even if the gear 11 further rotates and the engagement pin 11PR moves within a range MR. It is thus possible to use the rotational force of the transmitting gear 12 for opening and closing the door 3, and it is also possible to use the rotational force of the first gear 11 for moving the doll 5, after the engagement pin 11PR removes from the slot 12CA. That is to say, the configuration as shown in FIGS. 3A through 3D is capable of not only opening and closing the door 3 but also operating the performance of the doll 5 with a single motor, and in addition, it is possible to move the doll 5 without applying the driving force to the door 3. The timepiece 1 includes a mechanism as shown in FIGS. 3A through 3D in the mechanism body 6 (excluding the door 3). Next, a description will be given of a configuration of the mechanism body 6.

Figure 4:
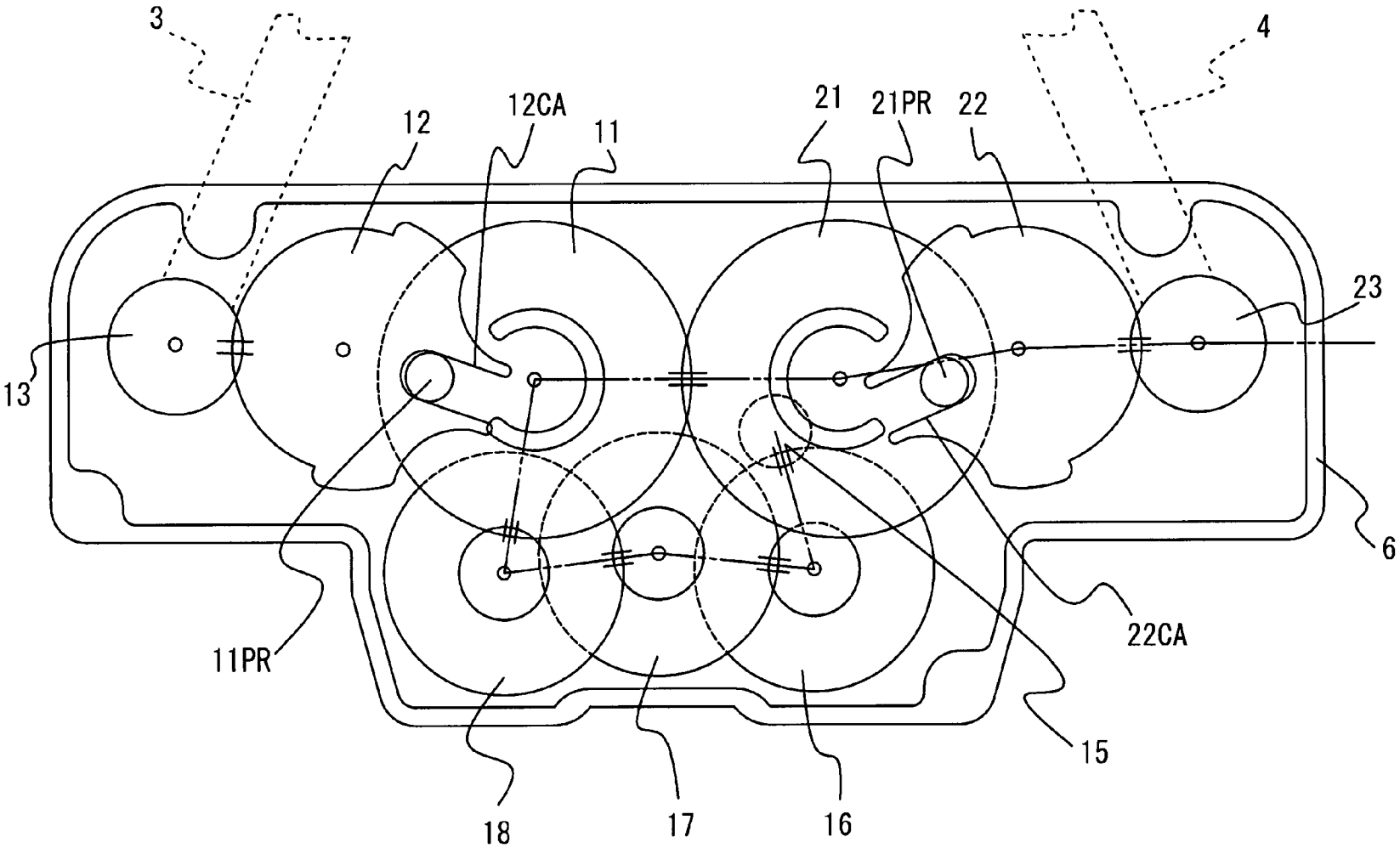
FIG. 4 is a structural view of a gear train of a mechanism body.

The mechanism body 6 includes the doors 3 and 4, which are double doors opening outward. FIG. 4 is a structural view of a gear train of the mechanism body 6. The mechanism body 6 includes the above-mentioned Geneva mechanism for the door 3 and another Geneva mechanism for the door 4. Hereinafter, in FIG. 4, the same components and configurations as those of FIGS. 3A through 3D have the same reference numerals. The driving force is transmitted from the motor 7 to the first gear 11 by way of a decelerating gear train including gears 15, 16, 17, and 18. The first gear 11 is capable of rotating the gear 12 only while the engagement pin 11PR is engaged with the slot 12CA in order to rotate the gear 13 provided in a subsequent stage to rotate the gear 13 and open and close the door 3.

The gear 11 is engaged with a first gear 21 in the Geneva mechanism that drives the door 4. Therefore, an engagement pin 21PR of the gear 21 is engaged with a slot 22CA so as to rotate a transmitting gear 22. The transmitting gear 22 is engaged with a gear 23 in a subsequent stage to rotate the gear 23 and open and close the door 4. The motor 7 rotates and counter rotates while the engagement pins 11PR and 21PR are respectively engaged with the slots 12CA and 22CA. Thus, the doors 3 and 4 can be opened and closed at the same time. The positions at which the engagement pins 11PR and 21PR respectively remove from the slots 12CA and 22CA are configured to the positions at which the doors 3 and 4 open and close.

The mechanism body 6, as described, transmits the rotation of the motor 7 to the gears 11 and 21 through the decelerating gear train in order to rotate the second gears (transmitting gears) 12 and 22 within the range where the engagement pins 11PR and 21PR are respectively engaged with the slots 12CA and 22CA. The mechanism body 6 includes a door open and close mechanism that opens and closes the doors by respectively engaging the second gears 12 and 22 with the gears 13 and 23 for opening and closing the doors. Thus, it is possible to open the doors 3 and 4 Outward with the rotation of the motor 7 and make the doll (decorative body) 5 arranged inside the doors come out.

Figure 5:
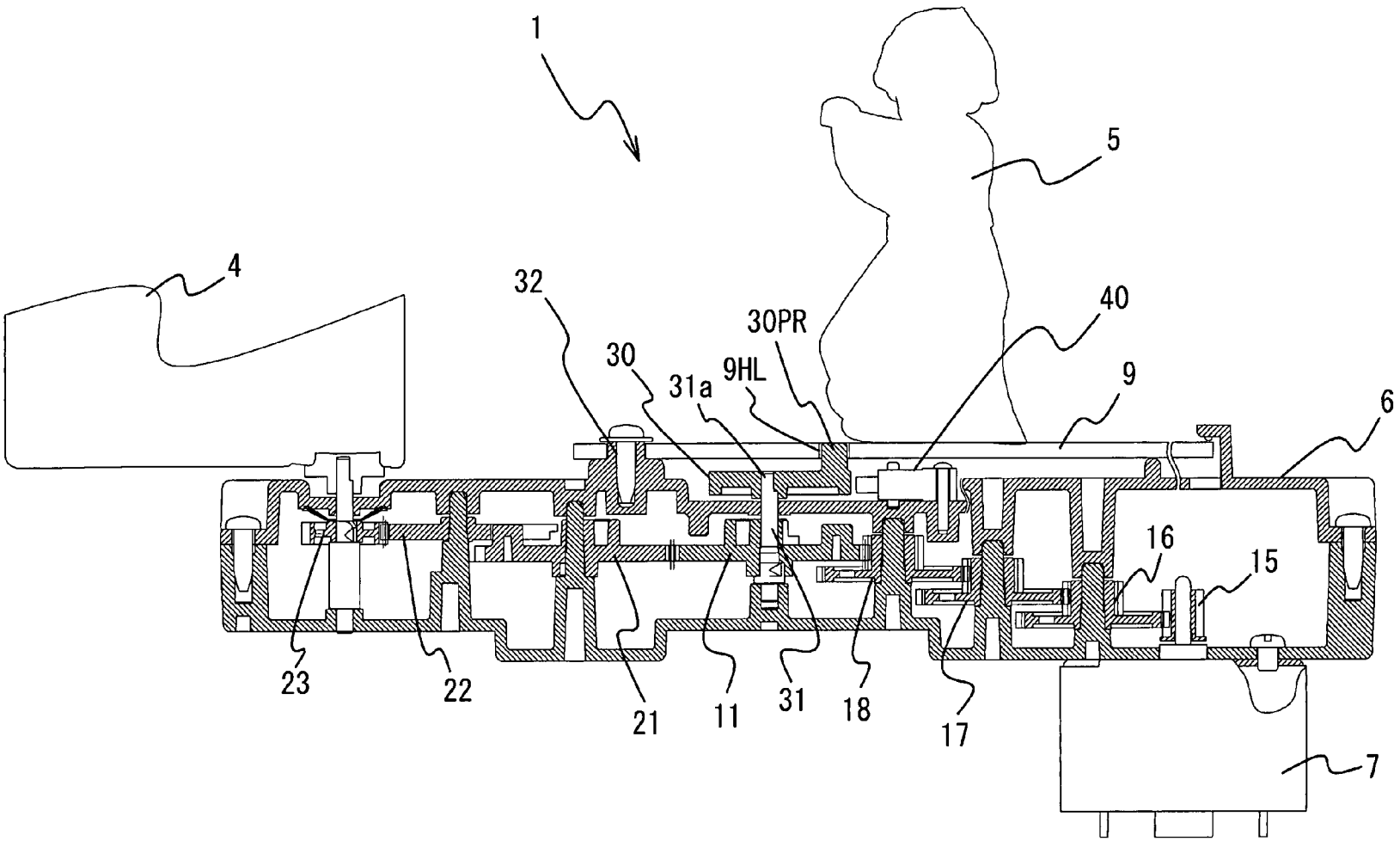
FIG. 5 is a cross-sectional view of the mechanism body.

Next, a description will be given of a decorative body operating mechanism. With the decorative body operating mechanism, the driving force of the motor 7 is transmitted to the doll 5 so as to move the doll 5. The timepiece 1 having the decorative body is configured to transmit the driving force of the first gear 11 to the doll 5. FIG. 5 is a cross-sectional view of the mechanism body 6, which is also a developed view taken along a chain double-dashed line shown in FIG. 4. Hereinafter, in FIG. 5, the same components and configurations as those of FIG. 4 have the same reference numerals. A cam 30 is fixed to an edge 31*a* of a rotation axis 31 is the first gear 11. A protrusion 30PR is formed on a top surface of the cam 30. The protrusion 30PR is fit with an opening 9HL formed in a bedplate 9 to which the doll 5 is fixed. The bedplate 9 is swingably provided at the center of a spindle 32. When the first gear 11 rotates, the cam 30 also rotates at the same time. The bedplate 9 swings according to the swing of the cam 30 through the protrusion 30PR. It is thus possible to move the doll 5 arranged on the bedplate 9.

After the doors 3 and 4 reach the fully opened positions (after the engagement pin 11PR removes from the slot 12CA), if the first gear 11 keeps on rotating counterclockwise in the direction for opening the door in FIG. 4, the engagement pin 11PR comes into contact with the circumference of the transmitting gear 12. This makes it impossible to continue the rotation, and the doll 5 stops operating. On the other hand, if the gear 11 rotates in the opposite direction, that is, clockwise in FIG. 4 and keeps on rotating, the engagement pin 11PR is engaged with the slot 12CA of the transmitting gear 12 and the doors 3 and 4 are closed to house the doll 5 in the end.

Figure 6A:
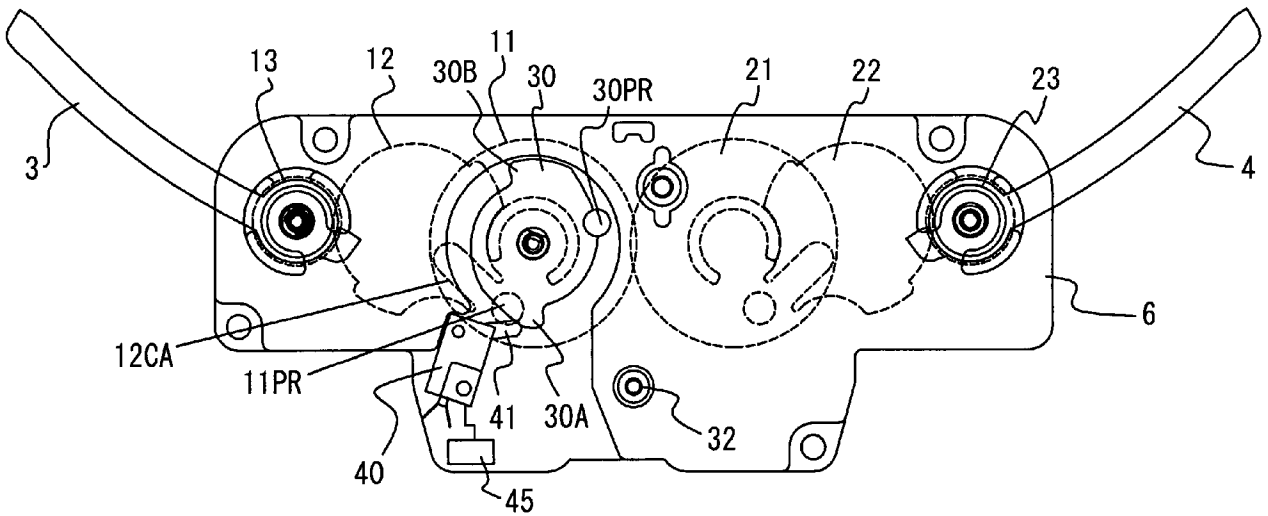
FIGS. 6A and 6B are views illustrating how the cam rotates, the cam being arranged above the first gear.
Figure 6B:
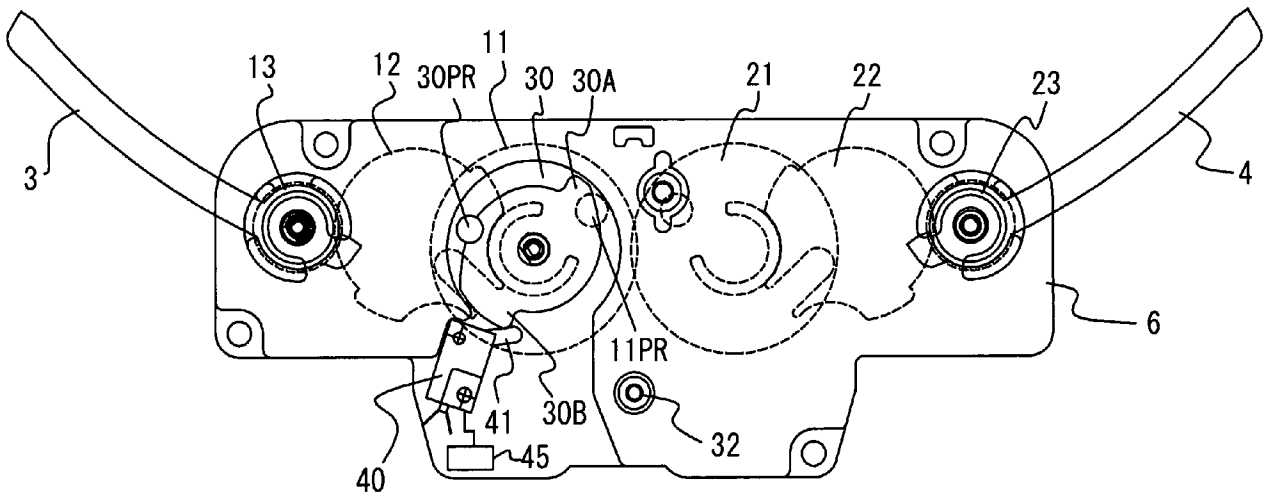

Therefore, the timepiece 1 having the decorative body includes a position detection mechanism that detects a rotational position of the gear 11 within a range where the engagement pin 11PR of the gear 11 is removed from the slot 12CA of the transmitting gear 12. A description will be given of the position detection mechanism with reference to FIGS. 6A and 6B. FIGS. 6A and 6B are views illustrating how the cam 30 rotates, the cam 30 being arranged above the first gear 11.FIG. 6A shows the position detection mechanism just after the engagement pin 11PR of the gear 11 removes from the slot 12CA of the transmitting gear 12. FIG. 6B shows the position detection mechanism when the gear 11 rotates (counterclockwise in FIGS. 6A and 6B) in a direction of moving away from the slot 12CA for a given amount.

The cam 30 rotates together with the gear 11, and includes two protrusions 30A and 30B radially protruded. A micro switch 40 is arranged in a circumference of the cam 30. The micro switch 40 includes a lever 41 in contact with the protrusions 30A and 30B. The protrusion 30A is arranged to be detected by the micro switch 40 just after the engagement pin 11PR is removed from the slot 12CA of the transmitting gear 12; namely, just after the doors 3 and 4 are fully opened. The protrusion 30B is arranged to detect the gear 11 having rotated for a given amount in the direction of moving away from the slot 12CA. The protrusion 30B is configured not to hit another member of the mechanism body 6 when the engagement pin 11PR rotates. A stopper may be provided in the mechanism body 6 to engage with the protrusion 30B. When the micro switch 40 malfunctions, the cam 30 may be configured not to rotate any more.

The position detection mechanism is configured to include the cam 30 having the protrusions 30A and 30B and the micro switch 40, as described. It is thus possible to detect the position of the gear 11, which rotates within a range where the engagement pin 11PR is removed from the slot 12CA. In particular, after the micro switch 40 detects the protrusion 30A first, the rotation direction of the motor 7 is changed (the rotation is reversed), whenever the micro switch 40 detects the protrusion 30A or 30B. Thus, the protrusion 30PR of the cam 30 is capable of swinging the bedplate 9 on which the doll 5 is fixed. A control circuit 45 is provided for controlling the micro switch 40, and the control circuit 45 predetermines the number of times the micro switch 40 detects the protrusion 30A and/or 30B of the cam 30. This can make the doll 5 move for a given period of time after the doors 3 and 4 open. Then, the motor 7 is configured to keep on rotating in the direction that the engagement pin 11PR is engaged with the slot 12CA (clockwise in FIGS. 6A and 6B), and thereby the doors 3 and 4 are closed to finish the performance (with reference to FIG. 3A). Here, FIGS. 6A and 6B illustrate a case where the driving force is applied to the doll 5 from the first gear 11 of the door 3. The driving force may be applied from the gear 21 of the door 4.

As described, the timepiece 1 fully opens the doors 3 and 4 (as shown in FIG. 3C), when the engagement pin 11PR of the first gear 11 rotates counterclockwise as shown in FIGS. 6A and 6B and the transmitting gear 12 removes from the slot 12CA. The operation of opening and closing the doors is finished in this state; however, the motor 7 keeps on rotating the gear 11. The cam 30 is coaxially fixed to the gear 11. The protrusion 30PR of the cam 30 is capable of operating the doll 5 by way of the bedplate 9. Particularly, on the timepiece 1 having the decorative body, when the micro switch 40 detects the protrusions 30A or 30B provided on the cam 30, the rotation of the motor 7 is changed so as to change the movement of the doll 5.

Figure 7A:
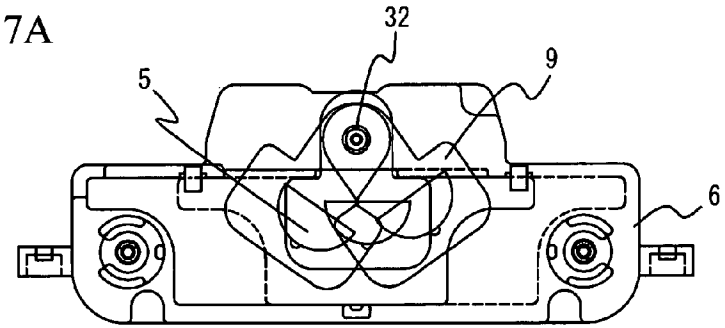
FIGS. 7A through 7C show the doll from three directions when the doll in the timepiece moves.
Figure 7B:
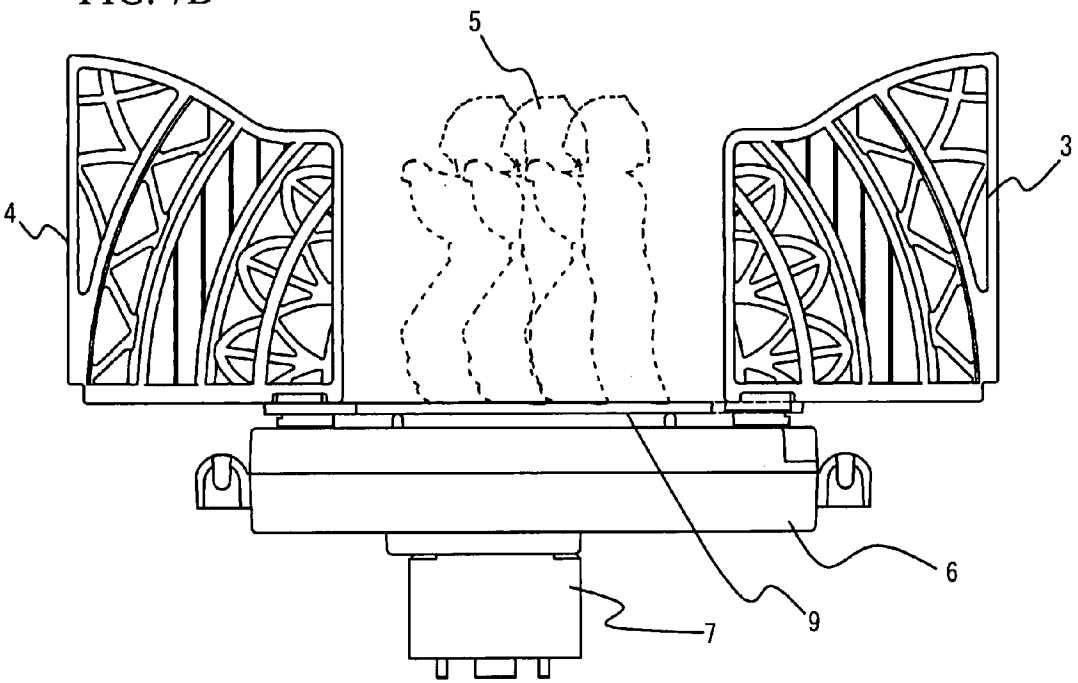
Figure 7C:
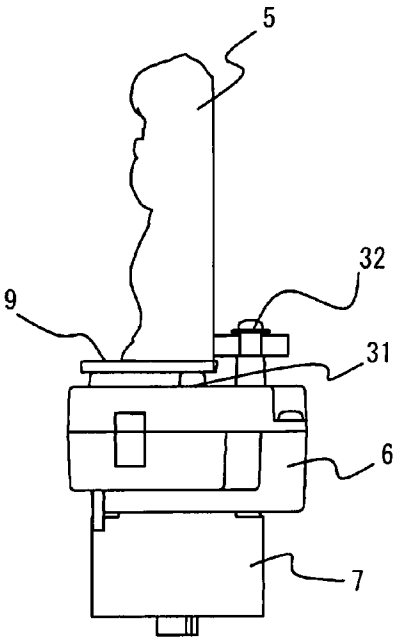

As described above, the timepiece 1 is capable of opening and closing the doors 3 and 4 and driving the doll (the decorative body) 5. Moreover, the timepiece 1 employs the Geneva mechanism in order to intermittently drive the transmitting gears 12 and 22, which drive the doors 3 and 4. It is thus possible to move the doll 5 in the state that the force is not applied for opening or closing the doors 3 and 4. The timepiece 1 having the decorative body in accordance with the present invention does not need any slipping members as in the conventional mechanism in order to generate the force to open the door while the decorative body is being operated. The timepiece 1 having the decorative body in accordance with the present invention does not have a problem of friction or the slipping sound. FIGS. 7A through 7C show the doll 5 from three directions when the doll 5 in the timepiece 1 moves. As shown in FIGS. 7A through 7C, the timepiece 1 having the decorative body is capable of giving changes in the movement of the doll 5, and thereby it is possible to offer an excellent performance.

In the above-mentioned embodiment, the micro switch 40 is employed for the position detection mechanism of the gear 11; however, an optical sensor may be employed instead of the micro switch 40. For example, an active sensor having a light-emitting portion and a light-receiving portion is provided. The light-emitting portion emits infrared rays and the light-receiving portion receives reflected lights. A reflecting film such as a metal foil is attached to a given position of the gear 11 or the cam 30 in order to detect the position. Additionally, the doors 3 and 4 open outward in accordance with the above-mentioned embodiment. One or more sliders may be provided in order to slide the doors 3 and 4 to the left and the right when opening the doors. In this case, a rack gear may be fixed to the doors 3 and 4 so that the rack gear can be moved by the rotation of the gears 13 or 23 for opening or closing the doors. Further, a single door may replace the doors 3 and 4 for simplification. In other words, at least one openable and closable door may be provided.

Moreover, the first gear 11 is used as a driving source for the decorative body operating mechanism that operates the doll 5 in the above-mentioned embodiment. However, without limiting to the aforementioned driving source, the driving force for moving the doll 5 may be obtained from the gears 15 through 18, which are included in the gear train arranged between the motor 7 and the first gear 11. The number of the dolls may be two or more, and the decorative body is not limited to the doll. The timepiece has been described as the decorative body driving mechanism in accordance with the present invention; however, the decorative body driving mechanism may be applied to another object as necessary.

The present invention is not limited to the above-mentioned embodiments, and other embodiments, variations and modifications may be made without departing from the scope of the present invention.

The present invention is based on Japanese Patent Application No. 2004-152643 filed on May 24, 2004,the entire disclosure of which is hereby incorporated by reference.

What is claimed is:

1. A decorative body driving mechanism having a decorative body therein and at least one openable and closable door arranged in front of the decorative body, the mechanism comprising:

a door open and close mechanism including:

a first gear rotatable in both directions with a motor; and a second gear being engaged with the first gear only within a given range to rotate intermittently and open and close said at least one openable and closable door, a decorative body operating mechanism transmitting a driving force of the motor to the decorative body to make the decorative body move, and a position detection mechanism to detect a rotational position of the first gear within a range where the first gear is not engaged with the second gear, the first gear having an engagement pin, the second gear having a slot for receiving said engagement pin rotation of said first gear causing said engagement pin to slidably engage said slot thereby causing said second gear to rotate and move said door between an open and a closed position.

2. The decorative body driving mechanism as claimed in claim 1, further comprising a gear train having multiple gears arranged between the motor and the first gear, wherein the decorative body operating mechanism makes the decorative body move by obtaining the driving force from the first gear or a gear included in the gear train.

3. The decorative body driving mechanism as claimed in claim 1, wherein:

a pair of the door open and close mechanisms are provided for a pair of the doors; and first gears of the pair of the door open and close mechanisms are engaged with each other.

* * * * *